United States Patent [19]

Windstrup

[11] 4,423,860

[45] Jan. 3, 1984

[54] VISE CLAMP

[76] Inventor: Robert F. Windstrup, 1008 Oak Park Ave., Oak Park, Ill. 60302

[21] Appl. No.: 376,406

[22] Filed: May 10, 1982

[51] Int. Cl.[3] ..... B25B 1/02

[52] U.S. Cl. ..... 269/180

[58] Field of Search ..... 269/165, 166, 171, 171.5, 269/179–183, 251, 252, 253, 244

[56] References Cited

U.S. PATENT DOCUMENTS

| | | | |
|---|---|---|---|
| 2,062,132 | 11/1936 | Jordan | 269/180 |
| 2,066,541 | 1/1937 | Schenk | 269/180 |
| 2,469,600 | 5/1949 | Jordan | 269/180 |
| 2,511,843 | 6/1950 | Graether | 269/171 |
| 2,764,047 | 9/1956 | Allbritton | 269/251 |
| 3,107,909 | 10/1963 | Kuchenbecker | 269/171.5 |

FOREIGN PATENT DOCUMENTS

| | | | |
|---|---|---|---|
| 703604 | 5/1931 | France | 269/251 |
| 17419 | of 1912 | United Kingdom | 269/166 |

*Primary Examiner*—Robert C. Watson
*Attorney, Agent, or Firm*—John J. Kowalik

[57] ABSTRACT

A vise clamp in which a movable jaw fits between and is slidable along a pair of guide rails of the vise base on surfaces normal to the clamping faces of the vise jaws and in which the novel movable jaw is tiltable to release and engage with a tension adjusting screw. The engaging surfaces on the movable jaw and the side rails are arranged to obtain force couples which hold the movable jaw in square position under load.

4 Claims, 7 Drawing Figures

VISE CLAMP

BACKGROUND OF THE INVENTION

A typical vise comprises guide rods attached to the movable vise jaw. Clearance must be provided in the guide rod holes in the support for the guides to move freely. The amount of clearance in these holes causes the movable jaw to assume an out of parallel position with respect to the fixed jaw of the vise.

Also, when a conventional vise is opened it intrudes into the area adjacent to the bench on which such vise is typically mounted, leaving only the guide rods to take vertical work loads.

SUMMARY OF THE INVENTION

The present invention comprehends a novel vise wherein the jaws are maintained in parallelism during the entire range of jaw positioning. The invention provides a novel arrangement of a jaw which is interlocked with aa pair of side rails and in precise guided engagement therewith so that under load the movable jaw does not shift out of parallel. Force couples on the two jaws result from the work load applied upon tightening of the jaws against a workpiece. When the vise clamp is opened, the movable jaw moves back over the bench, leaving the work area next to the bench unobstructed, and full bench support is provided for vertical work loads.

In conventional vises, opening of the vise extends the overhang length which must be supported by the guide rods, and therefore such rods must be built of great strength to provide a cantilever support.

In my novel vise clamp, opening of the jaws is not plagued with such problems. The entire clamp is made to rest on the bench and thus openings of 18 inches as well as 48 inches or more are feasible.

In a conventional clamp the pipe or wooden beam carries both tensile and bending loads when force is applied. Parallelism of the clamp jaw faces is affected by bending of the beam. The adjusting and tightening screw must be short because it is under compression and tends to buckle. The system is unstable in setting up work, requiring one hand to align the clamp.

In my novel vise clamp a pair of side rails are provided which support the jaws and control parallelism. No tension loads are imposed on these side rails. The bending loads can be easily controlled by proper distribution of material in the rails. The adjusting screw in my vise can be long and of small diameter since it operates only in tension under load and therefore will not buckle. The structure of my vise is square and thus easily supported flat on a bench, and the rails provide a flat support to align parts of the work. The entire structure in addition to being lighter than conventional is vastly more convenient to use.

An object of my invention is to provide a novel vise which utilizes a small diameter screw with a fine thread for moving the movable jaw which thus permits the use of a small diameter handle in the form of a knob for rotating the screw instead of a large cumbersome lever as a handle.

The invention contemplates the use of several small vises in lieu of one large vise as in the prior art, such small vises being designed to rest upon a work bench and to be spread apart to hold the work piece stable.

These and other objects and advantages will become more apparent from the specification and drawing, wherein.

DESCRIPTION OF THE INVENTION

Figure 2:
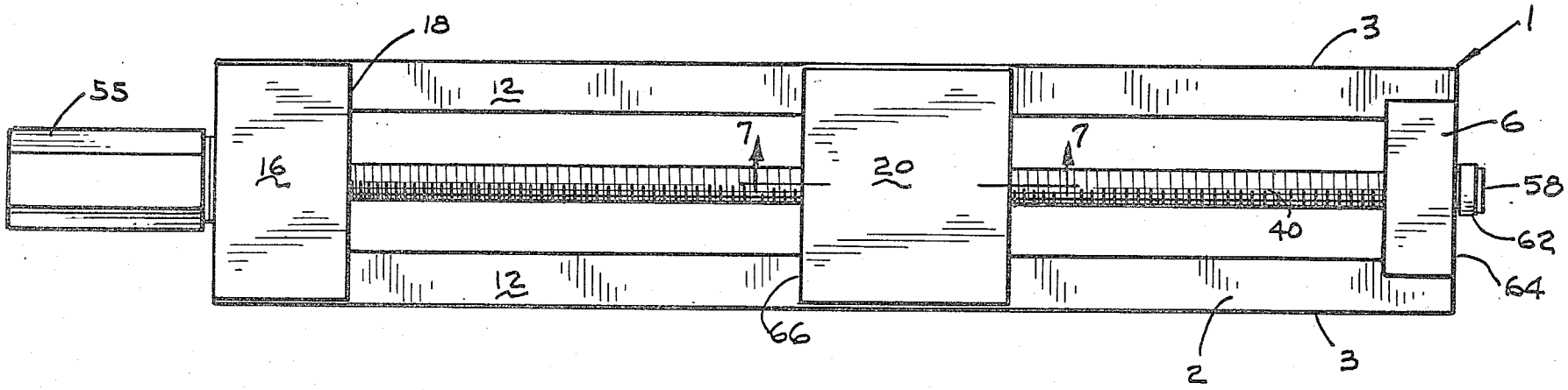
FIG. 2 is a top plan view of the novel vise.
Figure 1:
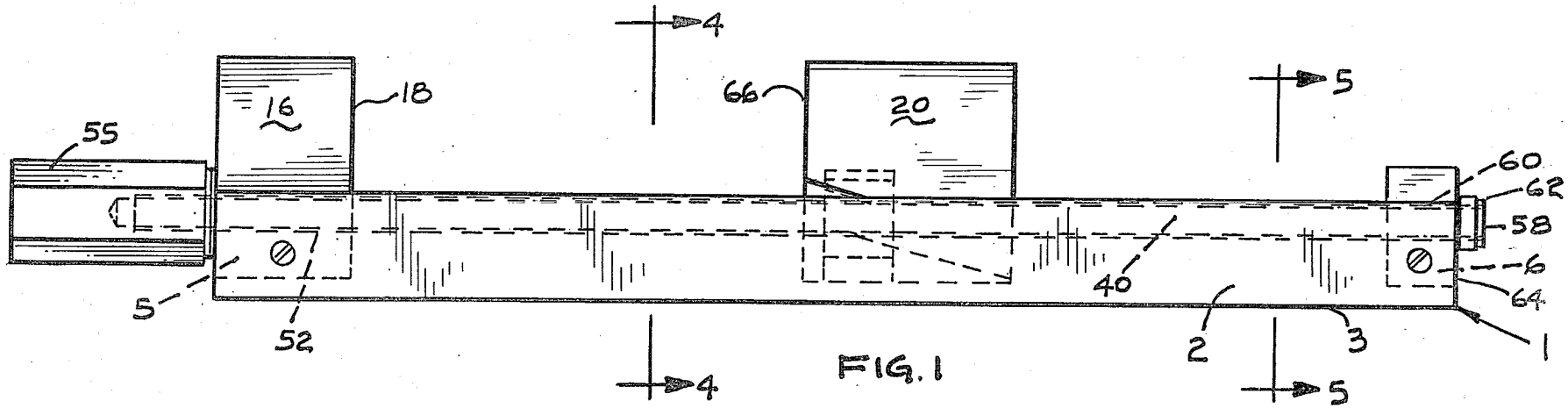
FIG. 1 is a side elevational view of the novel vise shown in operating position.
Figure 3:
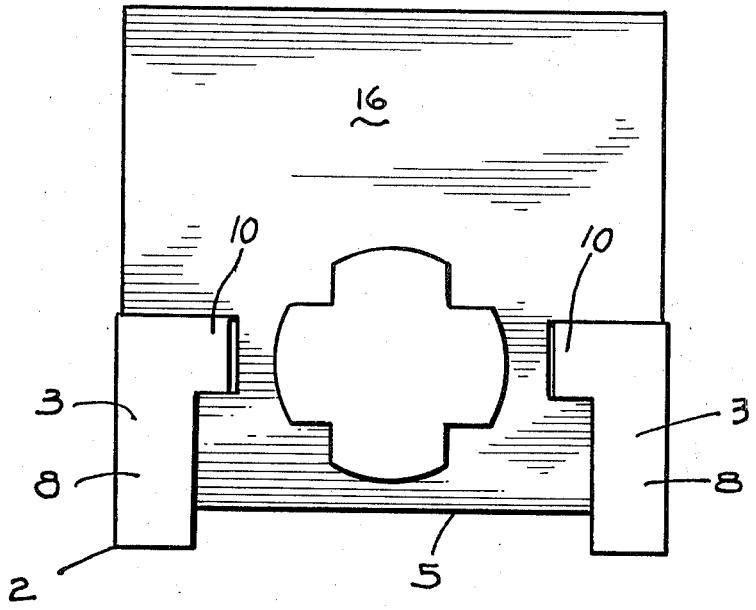
FIG. 3 is a front elevational view of the vise.
Figure 4:
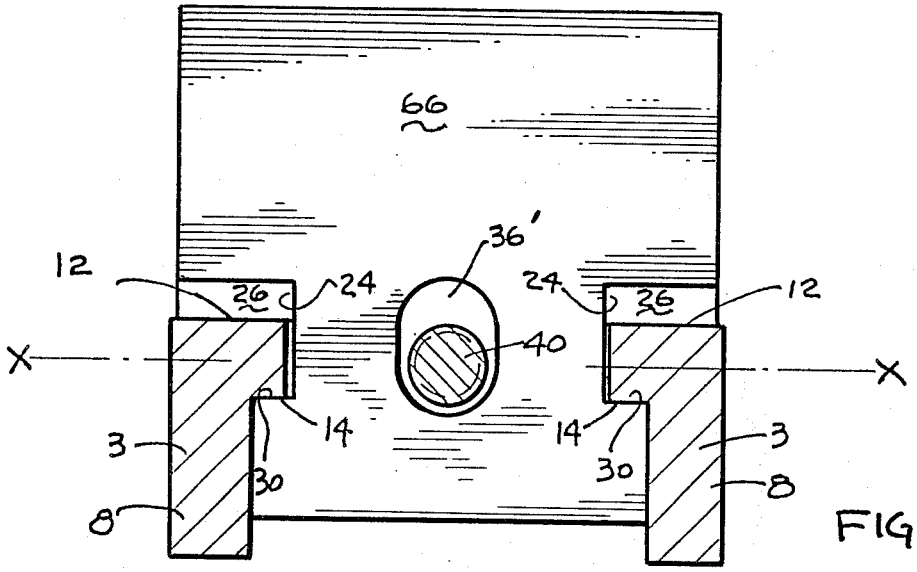
FIG. 4 is a cross-sectional view taken substantially on line 4—4 of FIG. 1.
Figure 5:
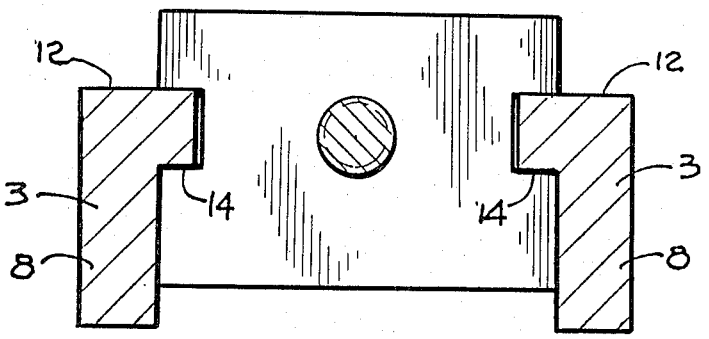
FIG. 5 is a cross-sectional view taken substantially on line 5—5 of FIG. 1.

The novel vise 1 shown in the drawings comprises a base frame structure 2 which includes a pair of parallel side rails 3,3 joined to each other at their respective front and rear ends by front and rear blocks or end members 5 and 6 to form the rectangular frame.

Each side member is of inverted L-shape in cross section having a vertical leg 8 and an inturned leg with top and bottom parallel guide surfaces 12 and 14.

The front end member may constitute part of the stationary jaw 16 which projects above the side rails and presents an inner jaw or clamp face 18 extending normal to the coplaner surfaces 12 of the side rails 3,3.

Figure 6:
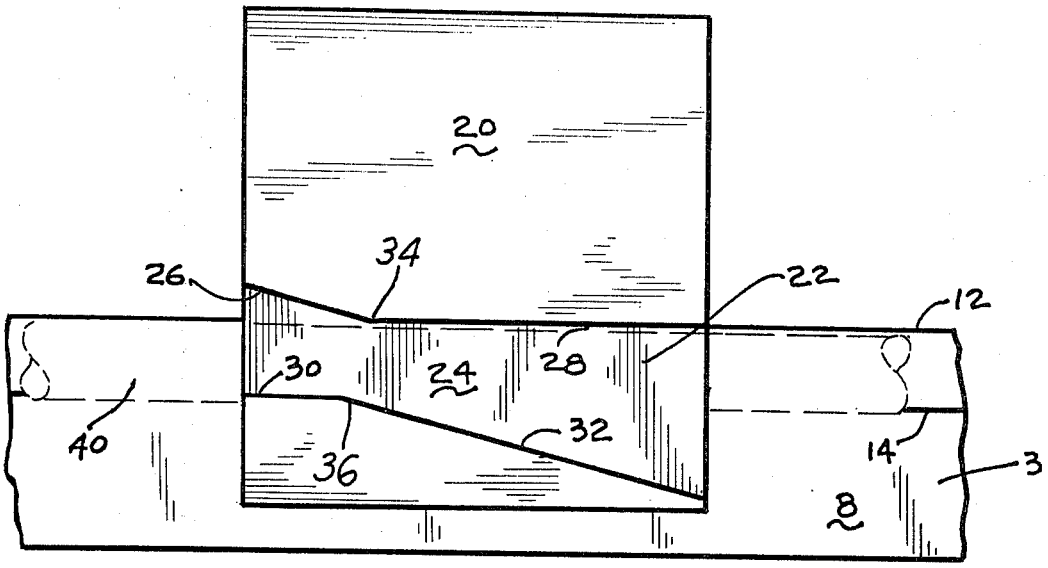
FIG. 6 is a fragmentary side elevational view of the movable jaw in association with the screw and the mounting rail on the far side.
Figure 7:
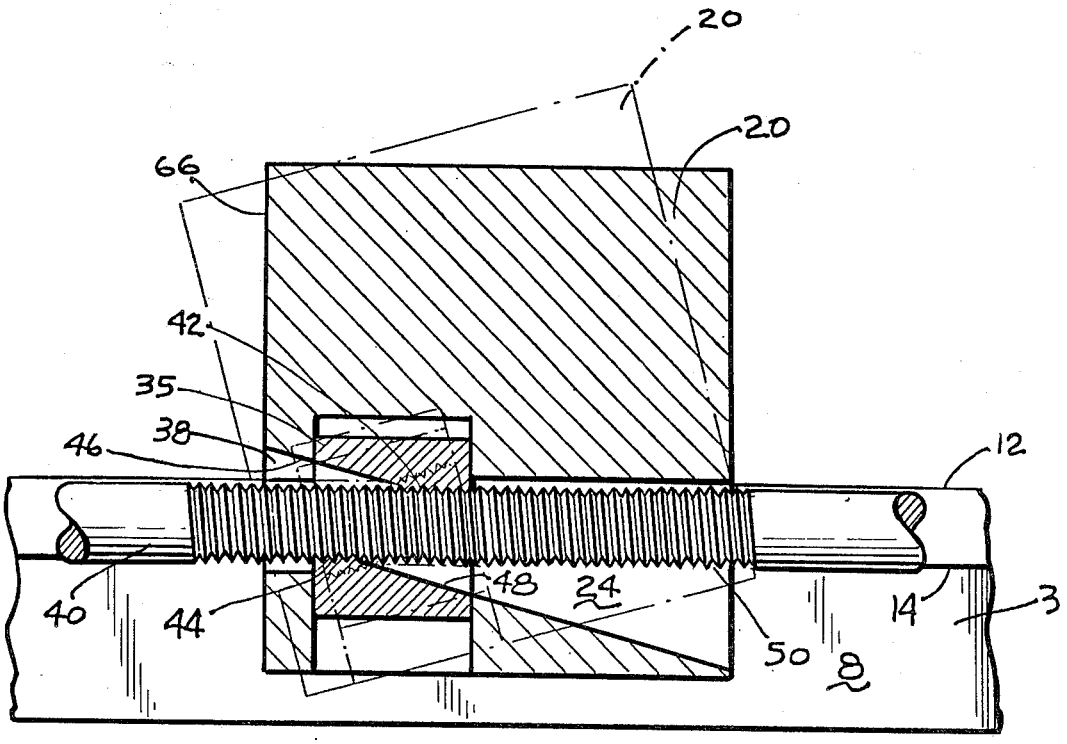
FIG. 7 is a composite view in longitudinal section taken on line 7—7 of FIG. 2 showing the operating position of the jaw in solid lines and the adjusting position in dotted lines.

A movable jaw 20 is fitted between the side rails 3,3 and at each side is slidably interlocked with the inturned leg of 10 of the related side rail by means of a horizontal fore and aft extending slot 22 which receives the related leg 10 therein. Each slot is defined by an inner vertical surface 24 on the side of the jaw and upper angularly related surfaces 26,28 and lower angularly related surfaces 30,32. It will be noted that surfaced 26,32 are parallel and surfaces 28,30 are parallel and that the apical intersections of surfaces 26,28 and 30,32 are vertically opposed, which allows the movable jaw to pivot about a horizontal axis x—x between adjusted operating position as seen in FIG. 6 and adjusting position shown in FIG. 7 in phantom lines.

The movable jaw 20 is provided with a nut 35 embedded and secured in an oval-shaped screw bore 36. The nut 35 provides for quick adjustment of the movable jaw and the nut comprises a bore 38 through which extends an adjusting screw 40. The nut has threads 42,44 at diagonal diametric upper and lower sides and unthreaded cylindrical surfaces at 46,48, such that in the upright functional position of the jaw 20, the threads 42,44 are engaged with the screw threads 50, and when the jaw 20 is tilted to the phantom position of FIG. 7, the threads 42,44 are disengaged from thread 50 and the jaw is slidable along the screw 40 and surfaces 28,32 ride along surfaces 12 and 14.

In the functional position the surfaces 26,30 respectively, engage the upper and lower surfaces 12 and 14 and the surface 26 has a larger area than surface 30 so that the bending moment forces are primarily impressed in compression against the extensive top surfaces 12 of the rails.

The adjusting screw extends through bore 52 in the front block 5 and is provided with a reaction thrust washer thereon positioned between jaw 18 and block 5 and the operating handle 55, which is appropriately fixed to the maximal end of the screw 40. The distal end 58 of the screw 40 is rotatable in a bore 60 extending through the rear block 6. A stop 62 may be provided on the distal end of the screw in the form of a locking nut which is located behind the rear side 64 of the rear block to prevent disassembly of the screw from the frame.

It will be apparent that the surfaces 28,30 and the top and bottom surfaces 12,14 are parallel and are spaced such that in the upright operating position of jaw 20, surface 28 engages surface 12 and surface 30 engages surface 14. The work engaging face 66 of the jaw 20 is normal to surfaces 12 and 14 and 28,30 and that work face 18 of the stationary jaw is normal to surfaces 12,14. Thus any workpiece clamped between surfaces 66,18 is positioned normal to the surfaces 12,14.

The foregoing description discloses the best mode of the invention known at this time. However, various other forms of the invention will hereafter become apparent within the scope of the appended claims.

I claim:

1. A vise comprising a longitudinal guide, a stationary jaw fixed with respect to said guide and having a work-engaging face generally normal to said guide, a jaw movable with respect to said guide longitudinally thereof and having a work-engaging face opposing said face on the stationary jaw, load bearing means cooperative with said guide for maintaining said movable jaw in squared relation to said fixed jaw, said guide comprising a frame having a pair of side rails with parallel top and bottom surfaces, said load bearing means simultaneously engaging said top and bottom surfaces of both rails upon application of a workload between the jaws, said movable jaw having a slot on each side thereof receiving the respective side rail therein, a first set of surfaces of the top and bottom sides of the slot arranged for full face engagement with the top and bottom surfaces of the associated side rail and providing said load bearing means, a second set of top and bottom surfaces on the top and bottom sides of each slot on the movable jaw intersecting the aforesaid top and bottom surfaces of the first set and forming vertically opposed apical edges providing a fulcrum for the movable jaw accommodating tilting thereof for quick adjustment.

2. The invention according to claim 1 and an adjusting screw reactively connected between the movable jaw and the stationary jaw and operative in tension for clampingly engaging a work-piece between the jaws, and said jaw having a nut comprising means engageable with threads on said screw attendant to said movable jaw being disposed in upright position with its top and bottom surfaces engaging said guide surfaces and said means on the nut and said top and bottom surfaces on the movable jaw being disengaged upon said movable jaw being disposed in tilted position.

3. The invention according to claim 1 and means on the movable jaw having threaded engagement with the screw in the upright position of the movable jaw, and disengageable with respect to said screw upon said movable jaw being disposed in tilted position.

4. A vise comprising a horizontally elongated frame having a pair of parallel spaced guide rails each with top and bottom parallel guide surfaces, a fixed jaw extending between and connected to one of the ends of the rails, a movable jaw slidably mounted between said rails and having a slot at each side thereof receiving the respective guide rail therein, each slot having top and bottom sides opposing the top and bottom guide surfaces of the respective side rail, a pair of downwardly converging faces formed on the top side of each slot and pair of upwardly converging faces formed on the bottom side of each slot, the faces of each pair merging into an apical edge, said edges being engageable with the respective guide surface on the rails to accommodate tilting of the movable jaw, a tension screw connected between said jaws, and nut means on the movable jaw engageable with the screw in upright position of the movable jaw and tiltable about the screw with the movable jaw for disengagement from the screw, and engagement and disengagement of the nut with respect to the screw occurs simultaneously with the engagement and disengagement of the respective faces on the movable jaw with the associated guide surfaces.

* * * * *